US007707828B2

(12) United States Patent
Leseman et al.

(10) Patent No.: US 7,707,828 B2
(45) Date of Patent: May 4, 2010

(54) METHOD AND APPARATUS FOR MANIPULATING AND DILUTING INTERNAL COMBUSTION ENGINE EXHAUST GASES

(75) Inventors: Gary Thelen Leseman, Houston, TX (US); Joseph Byron Davis, Sugar Land, TX (US)

(73) Assignee: Leseman Davis, LLC, Houston, TX (US)

( * ) Notice: Subject to any disclaimer, the term of this patent is extended or adjusted under 35 U.S.C. 154(b) by 0 days.

(21) Appl. No.: 11/608,587

(22) Filed: Dec. 8, 2006

(65) Prior Publication Data

US 2007/0137190 A1 Jun. 21, 2007

Related U.S. Application Data

(63) Continuation-in-part of application No. 11/307,712, filed on Feb. 17, 2006, now abandoned.

(60) Provisional application No. 60/751,459, filed on Dec. 19, 2005.

(51) Int. Cl.
*F02B 35/00* (2006.01)

(52) U.S. Cl. ..... 60/316; 60/274; 60/315; 60/317

(58) Field of Classification Search ..... 60/315–317, 60/319

See application file for complete search history.

(56) References Cited

U.S. PATENT DOCUMENTS

| | | | | | |
|---|---|---|---|---|---|
| 3,045,422 | A | | 7/1962 | Houdry | |
| 3,116,596 | A | * | 1/1964 | Voris et al. | 60/315 |
| 3,237,399 | A | * | 3/1966 | Sheffer et al. | 60/289 |
| 3,241,316 | A | * | 3/1966 | Endres | 60/39.5 |
| 3,712,065 | A | * | 1/1973 | Hurst | 60/274 |
| 4,418,532 | A | * | 12/1983 | Momose et al. | 60/316 |
| 4,912,927 | A | * | 4/1990 | Billington | 60/315 |
| 5,179,838 | A | * | 1/1993 | Kakuta | 60/605.1 |
| 5,184,501 | A | | 2/1993 | Lewis et al. | |
| 5,282,361 | A | * | 2/1994 | Sung | 60/315 |
| 5,822,980 | A | | 10/1998 | Chen | |
| 5,904,042 | A | | 5/1999 | Rohrbaugh | |
| 5,941,069 | A | * | 8/1999 | Heath | 60/307 |
| 5,983,632 | A | * | 11/1999 | Fujita et al. | 60/307 |

(Continued)

FOREIGN PATENT DOCUMENTS

DE 10 99 799 B 2/1961

(Continued)

OTHER PUBLICATIONS

International Search Report for Corresponding International Patent Application No. PCT/US2006/061798.

(Continued)

*Primary Examiner*—Thomas E. Denion
*Assistant Examiner*—Diem Tran
(74) *Attorney, Agent, or Firm*—Locke Lord Bissell & Liddell LLP

(57) ABSTRACT

A system for manipulating engine exhaust gases away from inhabited areas comprises an air pressurization system coupled in fluid communication to a housing. The housing is adapted to reside adjacent a terminal portion of an exhaust pipe so that pressurized air injected into the housing entrains the exhaust gases and disperses them from the housing.

52 Claims, 5 Drawing Sheets

U.S. PATENT DOCUMENTS

| | | | | |
|---|---|---|---|---|
| 6,308,740 | B1 * | 10/2001 | Smith et al. | 137/892 |
| 6,502,392 | B1 | 1/2003 | Paas | |
| 6,640,539 | B1 * | 11/2003 | Lewis et al. | 60/284 |
| 2004/0088968 | A1 | 5/2004 | Koelm et al. | |

FOREIGN PATENT DOCUMENTS

| | | | |
|---|---|---|---|
| JP | 59 122718 | A | 7/1984 |
| WO | WO 99/01649 | A | 1/1999 |

OTHER PUBLICATIONS

Written Opinion for Corresponding International Patent Application No. PCT/US2006/061798.

* cited by examiner

METHOD AND APPARATUS FOR MANIPULATING AND DILUTING INTERNAL COMBUSTION ENGINE EXHAUST GASES

CROSS REFERENCE TO RELATED APPLICATIONS

This application is a continuation-in-part of U.S. application Ser. No. 11/307,712, filed on Feb. 17, 2006, now abandoned, which claims benefit to and priority of U.S. Provisional Application No. 60/751,459, filed on Dec. 19, 2005.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention relates generally to manipulating the flow of exhaust gas from an internal combustion engine and, more specifically, to a method and apparatus for creating a high volume, high velocity air stream to direct an engine's exhaust gas away from a specific area and to dilute the exhaust gas.

2. Description of the Related Art

Internal combustion engines are used as energy sources in a variety of industries. The exhaust gases from such engines are typically noxious and otherwise unpleasant for humans, fauna, and flora. In those environments where workers are adjacent the internal combustion energy source, contact with the exhaust gases creates an unpleasant and potentially unhealthy working environment. By way of example and not limitation, offshore structures such as oil well drilling rigs or production platforms, seem particularly susceptible to contamination of working and other inhabited areas with internal combustion exhaust gases. Perhaps because usable square footage is at such a premium on offshore structures, stationary internal combustion engines are by necessity relatively near inhabited spaces. Disposing of the exhaust gases in a manner that minimizes contamination of inhabited areas is or should be a major concern. Factors such as exhaust exit placement and wind and weather conditions affect exhaust gas dispersion and dilution. In other words, low exhaust gas velocity may allow wind and other weather conditions to redirect exhaust gas back toward the exhaust discharge and/or inhabited areas.

Conventional efforts to prevent exhaust gases from contaminating inhabited areas usually involved increasing the exhaust gas pipe height, length, and/or location. However, increasing the exhaust pipe length does not increase the exhaust gas exit velocity or improve the dilution of the exhaust gas. Oftentimes, increasing the length also increases engine backpressure, which decreases engine efficiency. This is especially true for diesel engines, which are notoriously sensitive to exhaust backpressure. In some circumstances, it may have been necessary to move the stationary energy source to another location farther away from the inhabited areas.

The inventions disclosed and taught herein are directed to improved systems and methods for creating a higher fluid velocity adjacent the engine exhaust gas discharge and, thereby, improving dispersal and dilution of the engine exhaust gas to reduce or prevent contamination of inhabited areas.

BRIEF SUMMARY OF THE INVENTION

One aspect of the invention includes an engine exhaust system comprising a housing adapted to surround a terminal portion of an engine exhaust pipe, the housing has an exit portion and an ambient air pressurization system coupled to the housing, such that ambient air is injected into the housing by the air pressurization system and the injected air entrains exhaust gases exiting the exhaust pipe and the combined fluid flows out the exit portion at a higher velocity than the exhaust gas alone.

Another aspect of the invention includes a method of manipulating engine exhaust gases, which comprises providing a housing having a converging nozzle at one end; locating the housing adjacent a terminal portion of an engine exhaust pipe; injecting air into the annular region at a velocity greater than a velocity of exhaust gases exiting the pipe; entraining the exhaust gases with the injected air; and propelling the combined fluid through the nozzle.

DETAILED DESCRIPTION

Figure 1:
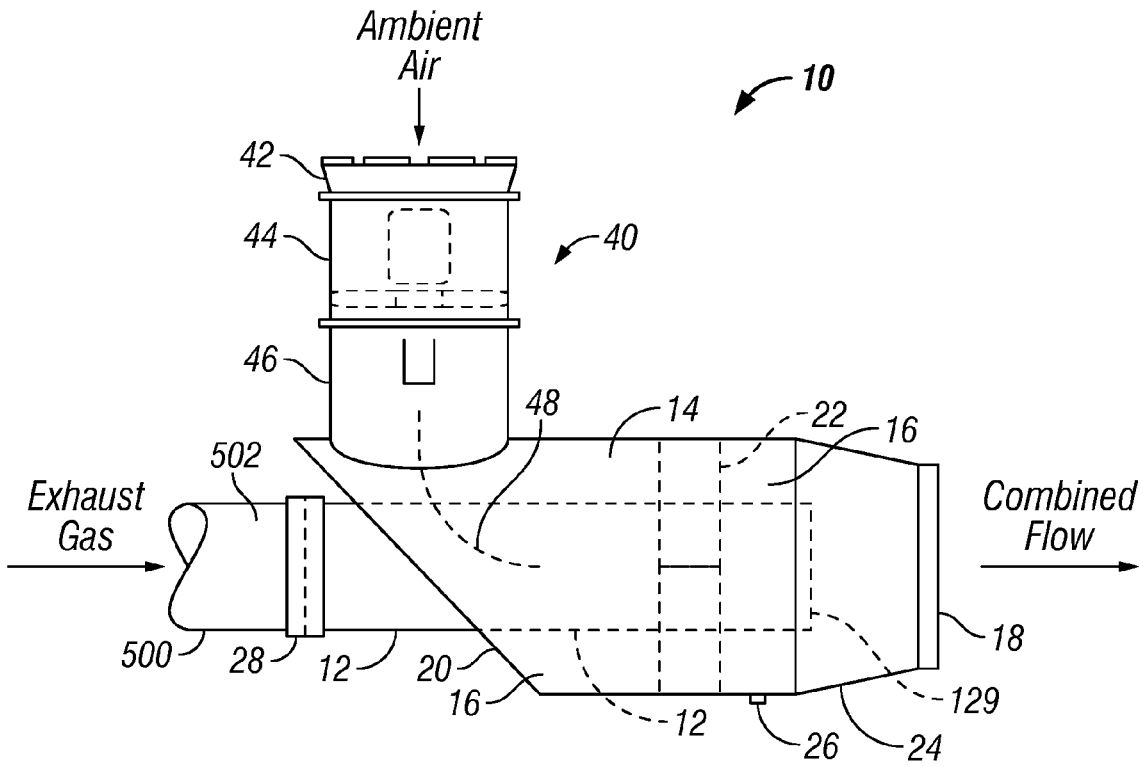
FIG. 1 illustrates a side view of a first embodiment incorporating aspects of the invention.

The Figures described above and the written description of specific structures and processes below shall not limit the scope of what Applicants have invented or the scope of protection sought for those inventions. The Figures and written description are provided to teach a person skilled in the art to make and use the inventions for which patent protection is sought. Those skilled in the art will appreciate that not all features of a commercial implementation of the inventions are described or shown for the sake of clarity and understanding. Persons of skill in this art also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, and from time to time.

While a developer's efforts might be complex and time-consuming in an absolute sense, such efforts would be, nevertheless, a routine undertaking for those of skill in this art having benefit of this disclosure. The inventions disclosed and taught herein are susceptible to numerous and various modifications and alternative forms.

The use of a singular term is not intended as limiting of the number of items. Also, the use of relational terms in this written description, such as, but not limited to, "top," "bottom," "left," "right," "upper," "lower," "down," "up," "side," and the like are used herein for clarity in reference to the Figures and are not intended to limit the invention or the embodiments that come within the scope of the appended claims.

Applicants have created an apparatus and method for manipulating engine exhaust gas with ambient air to direct and/or dilute the exhaust gas so that the exhaust gas does not recirculate to inhabited areas, such as workspaces, or, if recirculated, is diluted to an acceptable level. In general terms, a plenum may be formed about a terminal portion of a conventional exhaust pipe or system. Ambient air is pressurized into the plenum to entrain or otherwise increase the velocity of the exhaust gases exiting the housing for increased direction, dispersion and/or dilution. An annular region may be formed between an inside surface of the housing and an outside surface of the pipe. The exit portion may comprise a converging nozzle. The air pressurization system may comprise an air inlet, a pressurization device, and a housing transition. The air pressurization device may comprise, among other things, an axial fan, an axial blower, a ducted axial blower, a centrifugal fan, a centrifugal blower, a non-overloading fan or blower, or a non-stalling fan or blower. Turning and straightening vanes may be utilized in the housing. An adjustable pressurization system also may be used. The air pressurization system also may be computer controlled.

A method of dispersing engine exhaust gases may comprise providing a housing having a converging nozzle at one end locating the housing adjacent a terminal portion of an engine exhaust pipe; injecting air into the annular region at a velocity greater than a velocity of exhaust gases exiting the pipe; entraining the exhaust gases with the injected air; and propelling the combined fluid through the nozzle. An annular region may be created between the housing and the pipe. The housing may be located substantially cylindrically about the pipe. An air inlet hood may be provided for the air pressurization system. Determining how much pressurization from the air pressurization may be needed to adequately disperse the exhaust gases may also be done, as well as determining the current speed of an engine, and/or determining one or more weather conditions. In addition, adjusting the pressurization based on at least the engine speed and one or more transduced conditions may be done. In addition, increasing the operating efficiency of an engine may be achieved.

A first embodiment 10 incorporating aspects of the present invention is illustrated in FIGS: 1, 2 and 3. The embodiment 10 may comprise an exhaust sleeve 12 and an outer housing 14, which is adapted to encase at least a portion of the sleeve 12. FIG. 1 illustrates that the outer housing 14 may be concentrically disposed about the sleeve 12, thereby forming an annular plenum 16 between the outside of the sleeve 12 and the inside of the housing 14. The housing 14 comprises an exit portion 18 and a back portion 20, such as the back plate illustrated in FIG. 1. The outer housing 14 may be, and preferably is, sealed to the sleeve 12 at the back portion 20, such as by welding. The outer housing 14 may be supported concentrically about the sleeve 12 in any number of well-known ways, including the back portion 20 and/or straightening vanes 22. Straightening vanes 22 also function to reduce turbulence in the plenum 16 and to convert the kinetic energy of the pressurized air within the annular plenum 16 to static energy, which is sometimes referred to as static pressure regain. The exit portion 18 of the outer housing 14 may comprise a converging nozzle 24 adapted to increase the velocity of fluid flowing there through. It is preferred that the nozzle 24 be designed and constructed using conventional techniques to accelerate the fluid discharge velocity and to maintain a tight, fairly cylindrical, high velocity fluid flow away from the exit portion 18 at a velocity significantly greater than that of the prevailing wind velocity. It is preferred to have a drain port 26 located in the bottom portion of the outer housing 14, to facilitate draining liquids that may accumulate in the outer housing, such as by condensation, weather, or cleaning.

The sleeve 12 is adapted, such as by collar 28, to connect with existing exhaust system 500. Exhaust system 500 may be an existing exhaust pipe from the stationary engine or an exhaust pipe especially prepared for the present invention. It will be appreciated that the collar 28 may be a welded or un-welded connection, a removable joint, or a flexible connection. In some embodiments of the invention, not shown in FIG. 1, the exhaust pipe 500 may replace the sleeve 12 and/or the exhaust pipe 500 may be considered the sleeve 12.

Communicating with the plenum 16 is an ambient air pressurization system 40, which may comprise an air inlet 42, a pressurization device 44, and a transition 46. As illustrated in FIG. 1, the transition 46 is adapted to interface with the outer housing 14 so that fluid communication is established between the system 40 and the plenum 16. It is preferred that the transition 46 be sealed to the outer housing 14, such as by welding. Outer housing 14 may also include one or more turning vanes 48 to direct at least a portion of the pressurized ambient air toward the exit portion 18. Turning vanes 48 help to distribute the pressurized air more evenly through the annular plenum 16. It will be appreciated that the back portion 20 as illustrated in FIG. 1 also aids the redirection of the pressurized ambient air.

The air pressurization device 44 may be coupled to or integral with the transition 46, and the inlet 42 may be coupled to or integral with the pressurization device 44. For the embodiment illustrated in FIG. 1, the preferred pressurization device is a duct-mounted axial blower, such as are available from a wide variety of sources. Other pressurization devices, such as centrifugal blowers may also be used. As illustrated in FIG. 1, it is preferred that the pressurization system 40, or at least the pressurization device 44, is not subjected to the flow of hot engine exhaust gas. In some applications, however, it may be desired or required to subject the pressurization device 44 to the exhaust gases.

It will be appreciated at this point that the pressurization device 44 causes ambient air to be drawn into the air inlet 42 and injected into the plenum 16 through transition 46. The pressurized air injected into the plenum 16 by the pressurization device 44 creates an inductor effect within the plenum 16 at the discharge end 12*a* of the sleeve 12 and entrains or otherwise mixes with and dilutes the exhaust gases that are exiting the sleeve 12 and the combined fluid volume is accelerated through the nozzle 24 for dispersion. The injection of pressurized air may be used to create a pressure reduction in the exhaust gases in exhaust system 500 (and sleeve 12) thereby increasing engine efficiency.

It is preferred that the pressurization device 40 be designed to overcome the internal airflow resistance pressure imposed by the transition 46, internal turning vanes 48, plenum 16, sleeve 12, straightening vanes 22, and discharge nozzle 24, and create an exit velocity to counteract any prevailing wind speed. It is preferred that the system 10 be designed such that the engine exhaust can be propelled from the end of the nozzle 18 some 50 feet to 100 feet, or more, depending on prevailing wind speed, in a tight substantially cylindrical air pattern or column for maximum manipulation and dilution into the ambient air.

Figure 2:
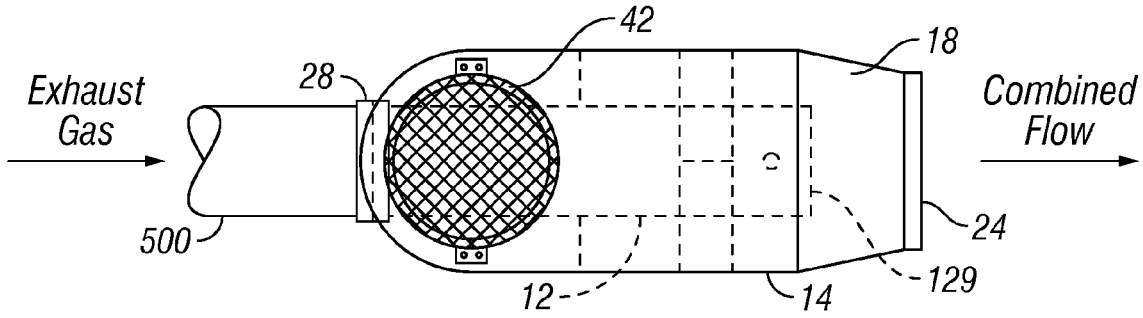
FIG. 2 illustrates a plan view of the embodiment illustrated in FIG. 1.
Figure 3:
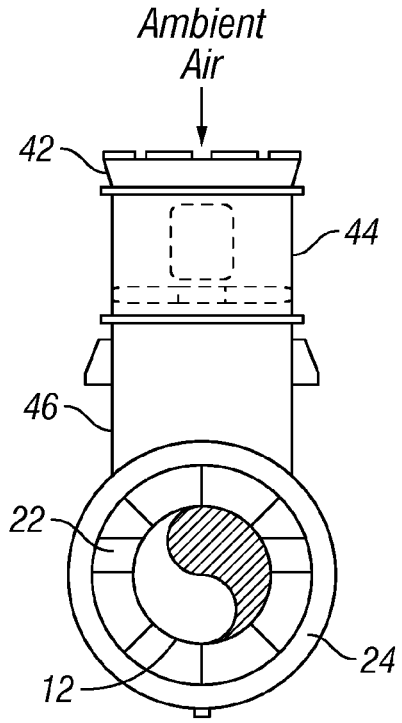
FIG. 3 illustrates an end view of the embodiment illustrated in FIG. 2.
Figure 4:
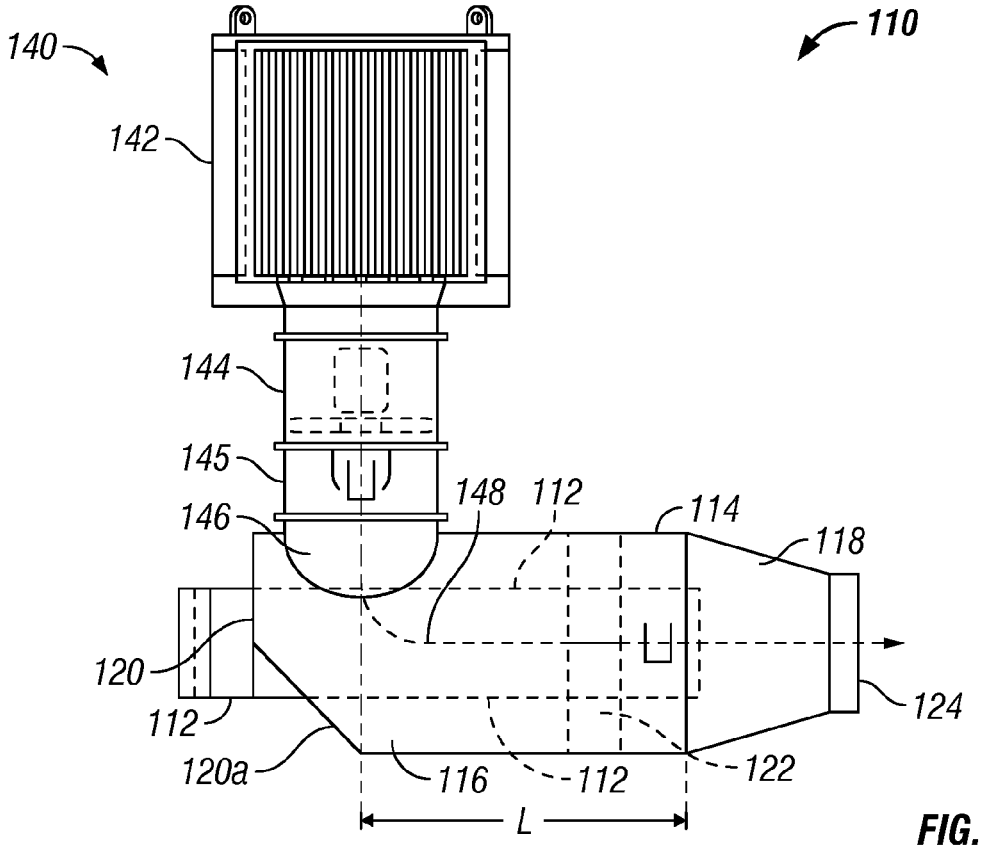
FIG. 4 illustrates a side view of a second embodiment of the invention incorporating aspects of the invention.
Figure 5:
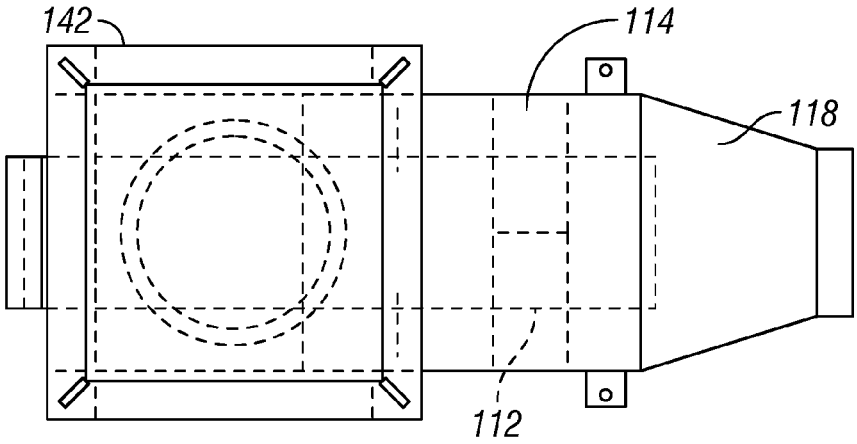
FIG. 5 illustrates a plan view of the embodiment illustrated in FIG. 4.
Figure 6:
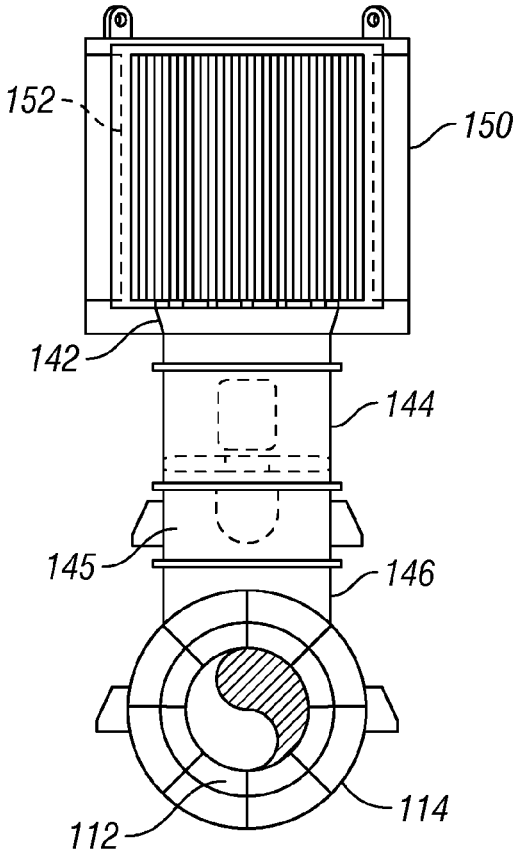
FIG. 6 illustrates an end view of the embodiment illustrated in FIG. 5.

A presently preferred embodiment 110 incorporating aspects of the present invention is shown in FIGS. 4, 5 and 6. Similar to the embodiment 10 shown in FIGS. 1, 2 and 3, this presently preferred embodiment 110 comprises an exhaust sleeve 112 and an outer housing 114 that encases a portion of the sleeve 112. An annular plenum 116 is formed between the outside of the sleeve 112 and the inside of the housing 114. The housing 114 comprises an exit nozzle 118 and a back plate 120. The outer housing 114 is sealed to the sleeve 112 at the back plate 120 by welding and helps to support the outer housing 114 concentrically about the sleeve 112. Straightening vanes 122 also support the outer housing 114 and may function to reduce turbulence in the plenum 116 and to convert the kinetic energy of the pressurized air within the annular plenum 116 to static energy. The exit nozzle 118 comprises a 30° converging nozzle designed and constructed using conventional techniques to accelerate the fluid discharge velocity and to maintain a tight, fairly cylindrical, high velocity fluid flow away from the system 110 at a velocity significantly greater than that of the prevailing wind velocity. While FIG. 4 shows the exhaust sleeve 112 terminating within the nozzle 118, it will be appreciated that the exhaust sleeve 112 may also terminate within the housing 114 as required or desired by design criteria.

The ambient air pressurization system 140 comprises an air inlet 142, a pressurization device 144, a mounting spool or vane section 145, and a transition 146. As illustrated in FIGS. 4 and 6, the transition 146 is adapted to interface with the outer housing 114 adjacent the back plate 120 so that fluid communication is established between the system 140 and the plenum 116. The transition 146 is sealed to the outer housing 114 such as by welding. The outer housing 114 and/or the transition 146 may also include turning vane 148 that extends 180 degrees along the outer surface of the sleeve 112 to direct approximately one-half of the pressurized ambient air toward the exit nozzle 118. It will be appreciated that the back plate 120, primarily portion 120*a*, redirects the other portion of the pressurized ambient air.

The air pressurization device 144 is coupled to an inlet 142 and a transition 146. The pressurization device 144 may also include a mounting spool or vane section 145, as may be desired, to provide a uniform velocity profile across the pressurization device 144 diameter. The pressurization device 144 and mounting spool/vane section 145 may be considered a single device or as separate devices for purposes of this disclosure. In this preferred embodiment, the pressurization device 144 may be a Series 44 ducted axial fan available from Hartzell Fan, Inc., Piqua, Ohio. As illustrated in FIG. 6, air inlet 142 comprises a hood 150 having one or more elements 152 adapted to prevent water and other contaminants from entering or contacting the air pressurization device 144. As shown in FIG. 4, it is presently preferred that the nozzle 118 be spaced a distance "L" from the centerline of the pressurization device 144, where L ranges between about 1.5 to about 2.5 times the nominal diameter of the pressurization device 144, inclusive, and most preferably about 2 times the nominal diameter. Further, it is preferred that the area of the annular region created between the housing 114 and the sleeve 112 is substantially the same as the discharge area of the pressurization device 144 (or mounting spool/vane section 145), and most preferably, equal to or greater than the discharge area.

It is preferred that the embodiment 110 be fabricated from stainless steel, such as a series 300 stainless steel, and most preferably series 316 stainless steel. However, it will be appreciated that the embodiment 110 and other embodiments incorporating aspects of the inventions described herein may be fabricated from many other materials and combination of materials, including, but not limited to, carbon steel, galvanized steel, or other suitable heat and/or corrosion resistant material including metallic alloys, and non-metallic materials, such as fiberglass and composites. Such materials may be coated with a corrosion resistant and/or heat resistant coating and/or be insulated with heat resistant thermal barrier material or acoustical material.

One specific example of an implementation based on the preferred embodiment illustrated in FIGS. 4-6, a system was designed for an internal combustion diesel engine (EMD 16-645-E9) having a 22 inch exhaust pipe (nominal OD). According to the engine manufacturer, at full load, this particular engine created about 15,400 cubic feet per minute of exhaust gas, or an exit velocity of about 6,400 feet per minute (about 72 miles per hour). Exhaust volume for this engine at idle was estimated at about 25% of full load or about 3,850 fpm (about 44 mph). It has been found that unwanted recirculation or redirection of exhaust gases rarely, if ever occurs, at full engine load conditions. Therefore, the design criteria for this implementation were set for an air pressurization device 144 sufficient to move a volume of ambient air equal to or greater than the full load engine exhaust volume when the engine is at idle. In other words, the combined fluid flow out of the system 110 when the engine is at idle was desired to be at least equal to and preferably greater than about 19,250 cfm. In addition, it was desired for this implementation that the pressurization device 144 be able to move a volume of ambient air substantially equal to the volume of exhaust gases at full engine load at a static pressure greater than the combined full load fluid flow pressure loss at the nozzle 118 exit.

For this particular implementation, a Hartzell Series 44 ducted axial fan was selected having an output of about 15,000 cfm and about 17,700 cfm at a static pressures of about 3 and about 2 inches of water, respectively. The nominal diameter of this fan was about 33 inches resulting in a discharge area of about 5.94 square feet. Therefore, the nominal diameter of the outer housing 114 was set at about 40 inches to create an annular area between the exhaust sleeve 112 and the housing 114 of about 5.94 $ft^2$, and the dimension "L" was set at about 66 inches. A 30° nozzle 118 having an entrance diameter of about 40 inches and an exit diameter of about 29 inches was used, and the exhaust sleeve 112 extended into the nozzle entrance about 2 inches.

At full engine load, the system 110 will eject diluted exhaust gases at about 30,000 cfm, or about 6,800 fpm (~77 mph). At fifty percent load, the engine will produce about 7,700 cfm of exhaust gases and the axial fan 144 would inject something above 15,000 cfm of ambient air into the system 110 because of the decreased load on the fan. Even at engine idle, the system 110 would eject diluted exhaust gases at about 21,500 cfm (~55 mph).

Figure 7:
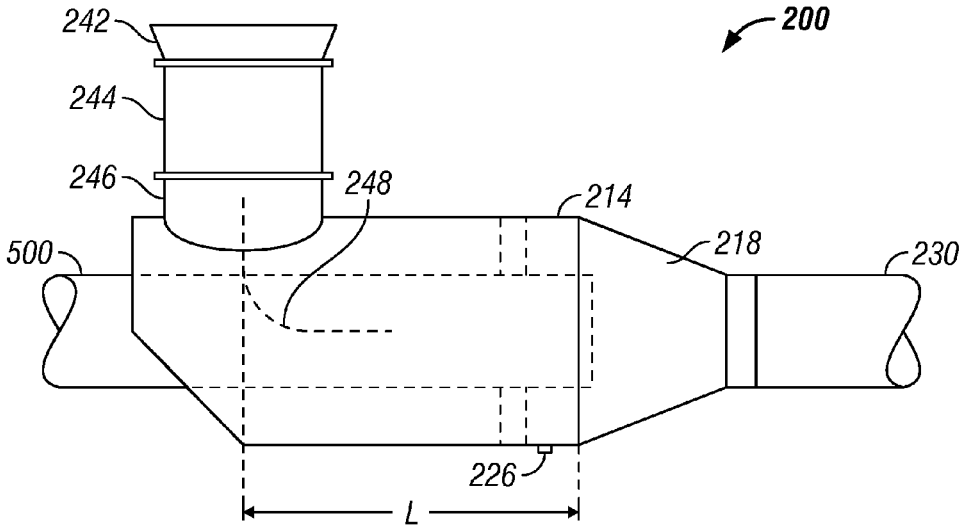
FIG. 7 illustrates another embodiment of the invention.

The inventions described herein may be used at locations in the exhaust system other than at the end of the exhaust system 500. For example, as illustrated in FIG. 7, a system 200 may be placed in the exhaust system 500, such that combined exhaust/ambient air pipe 230 will continue past the system 200 before final termination. Space, design, and routing requirements may dictate this type of installation. For example, those of skill in the art may want to place the system 200 at a point in the exhaust system where the engine exhaust back pressure becomes an engine efficiency issue. Also, more than one system 200 may be placed in an exhaust system in series as needed, and may be combined with silencers or other exhaust equipment as desired.

Figure 8:
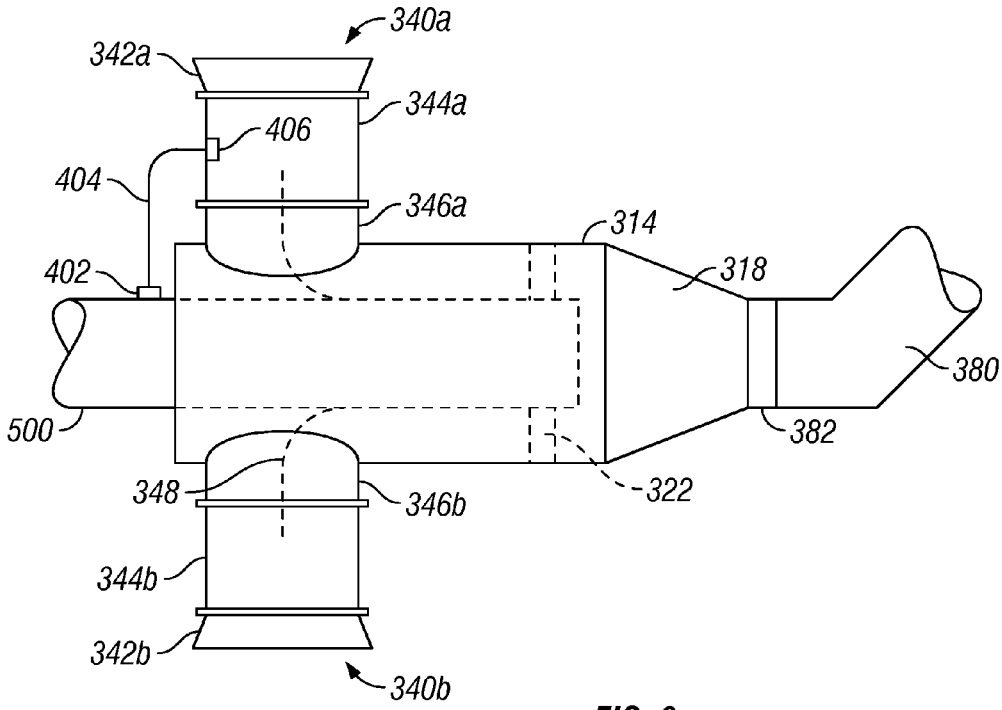
FIG. 8 illustrates another embodiment of the invention having a directable exit nozzle.

FIG. 8 illustrates another embodiment 300. In this system, housing 314 has two ambient air pressurization systems 340*a*, 340*b*. Each pressurization system 340 comprises an inlet 342, a pressurization device 344 (with or without a mounting spool or vane section), and a transition 346. As mentioned before, when the internal combustion engine is being run at full load, the exhaust gas exit velocity may be sufficiently high to effect adequate direction or dispersal of the gases under certain weather conditions. In such cases, having two or more air pressurization systems 340 allows multiple systems to be run when needed, such as at idle or when weather conditions, such as wind speed or direction, have changed and to run fewer systems when conditions do not require as much injection velocity. Although the embodiment shown in FIG. 8 utilizes two air pressurization systems, it will be appreciated that a plurality of pressurization device may be utilized, as desired or required. In addition, it will be appreciated that equivalent control and functionality may be achieved by having the capability to run the air pressurization device at various levels of pressurization, such as speeds or loads. For example, the embodiment shown and described with reference to FIGS. 4-6 may utilize or have a variable speed air pressurization device. Although not shown in FIG. 8, those persons of skill will appreciate that implementations utilizing multiple pressurization devices, one or more of which may not used form time to time, may benefit from back flow restrictors, such as dampers, to prevent the pressurized fluid from escaping through the inactive pressurization device.

FIG. 8 also illustrates a directable exit nozzle 380. Exit nozzle 380 may be rotatably mounted to system nozzle 318 so that the direction of the combined exhaust gas and air exit in a direction that promotes the most efficient dispersion of exhaust gases. The nozzle 380 may be manually rotatable or may be automatically rotated by any number of well known devices 382, such as, but not limited to, pneumatic, electronic/electrical, and mechanical.

As will be discussed in more detail below, automatic or semi-automatic operation of the system may be desired for numerous reasons. One method of operation comprises an air pressurization device control signal 404 that instructs the air pressurization device 340 to start under certain defined conditions. For example, as shown in FIG. 8, a temperature sensor 402 may be thermally coupled to the exhaust pipe 500 or some other component of the exhaust-conveying system. When the temperature sensor 402 transduces a temperature above a certain level, for example 300°F., a control circuit 406, preferably adjacent the air pressurization device 340, causes the air pressurization device 340 to start. It will be appreciated that a variable speed air pressurization device 340 may be controlled based on the transduced temperature with the output of the device 340 being a function of the transduced temperature, such as an inverse relationship.

Figure 9:
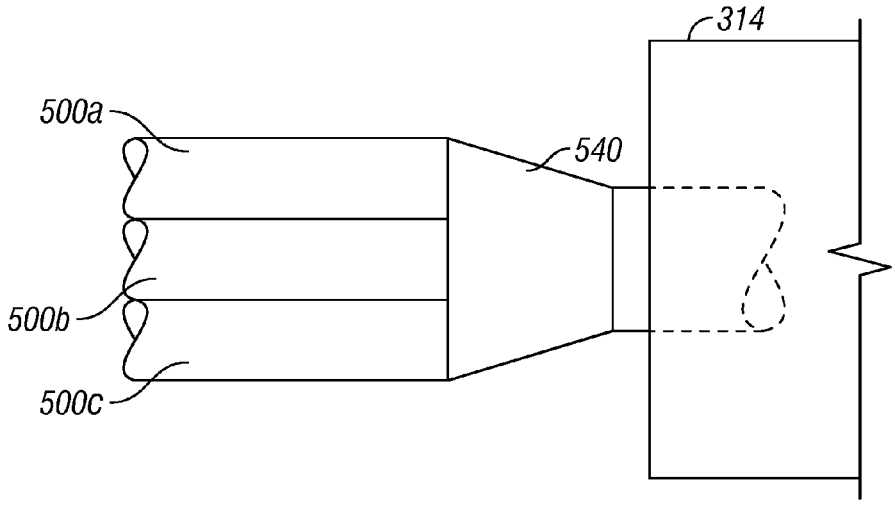
FIG. 9 illustrates another embodiment of the invention receiving exhausts from multiple sources.

FIG. 9 illustrates a partial embodiment that illustrates the broad applicability of the present invention. FIG. 9 teaches that a single dispersion system, 114, 314, may handle exhaust from multiple sources. For example and without limitation, a dispersion system 314 may accept multiple exhaust pipes 500*a*, 500*b* from a single engine or exhaust pipes 500*a*, 500*b*, & 500*c* from multiple engines. Those of skill in the art having the benefit of this disclosure will appreciate how to design a dispersion system to handle such increased exhaust loads.

Figure 10:
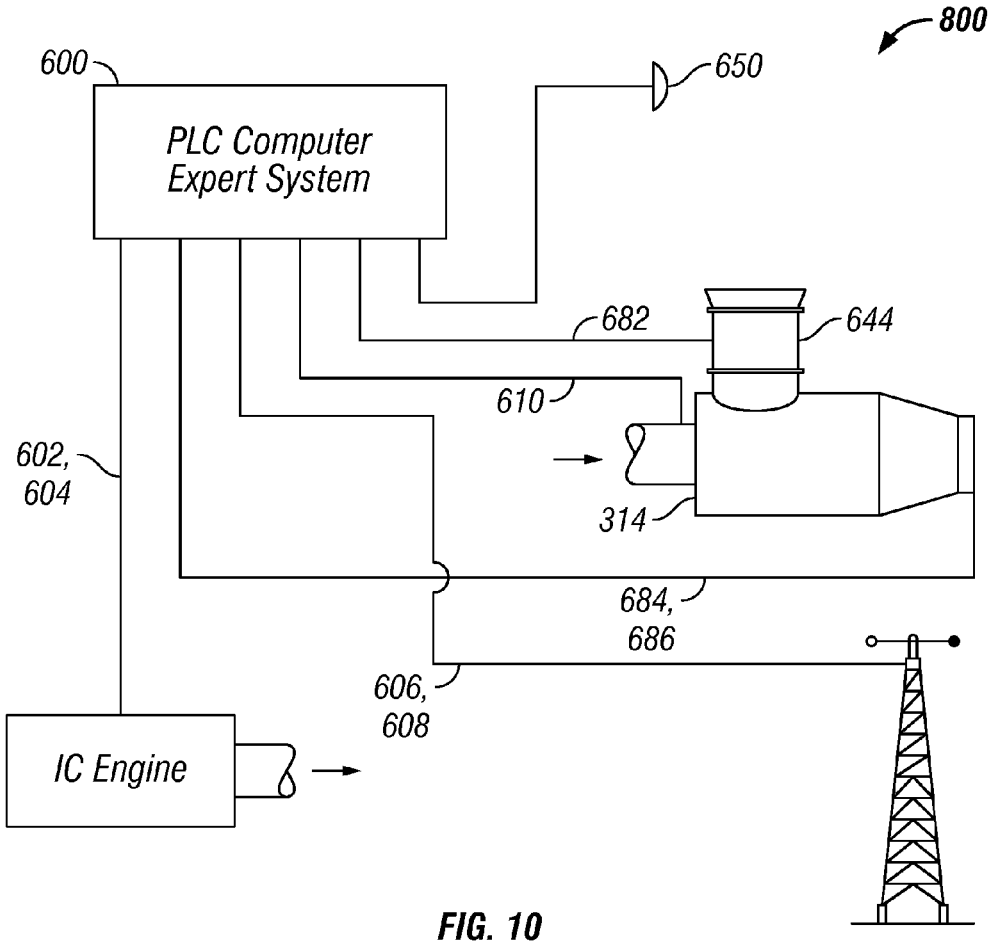
FIG. 10 illustrates another embodiment of the invention interfaced with a computer control system.

Sophisticated implementations of the inventions disclosed herein may comprise computer or expert systems that control the system in response to one or more inputs or conditions. For example, FIG. 10 illustrates a dispersion system 800 in which a programmed logic controller, computer, or other such system 600 may monitor or detect, for example, engine speed 602, engine load 604, wind speed 606, wind direction 608, exhaust temperature 610, or exit velocity 684. At low engine speeds, an appropriately constructed or programmed computer 600 may instruct 682 the air pressurization device 644 to run at or near maximum pressure. Alternately, the PLC 600 may instruct a second or third air pressurization device (not shown) to start up or increase or decrease output. As weather conditions change and/or as engine speed or exhaust temperature increases, the expert system 600 may instruct or allow the air pressurization device 644 to slow down because of the increase in exhaust gas velocity. Alternately, the computer 600 may slow down or turn off one or more air pressurization devices. In other embodiments, a workspace or inhabited area, such as the moon pool on a drilling rig, may have one or more carbon monoxide detectors 650 or other transducers for detecting when engine exhaust gases are being circulated to the area. In response to such information from the inputs, the PLC 600 may increase the output of the air pressurization system 644 or systems by increasing blower speed or bringing more systems online, and/or may rotate 686 a directable nozzle (See FIG. 8) to a desired orientation.

Other and further embodiments can be devised without departing from the general disclosure thereof For example, embodiments incorporating one or more aspects of the inventions disclosed herein may be used in any orientation vertical, horizontal, or otherwise without affecting the function and purpose. Although the descriptions above were directed to single engine exhaust, it will be appreciated that the systems can be modified and utilized to accommodate combined multiple internal combustion engine exhaust pipes arrangements. Further, the various methods and embodiments of the improved completion system can be included in combination with each other to produce variations of the disclosed methods and embodiments. Discussion of singular elements can include plural elements and vice-versa. Some elements of the invention have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalents of the following claims.

What is claimed is:

1. A system for manipulating engine exhaust away from a structure comprising:

a housing coupled to a terminal portion of an exhaust pipe, the exhaust pipe associated with an engine on the structure through which exhaust gasses flow at a first velocity; and a separately motorized ambient air pressurization system coupled to the housing in fluid communication therewith and configured to inject pressurized air into the housing such that the injected air combines with the exhaust gasses exiting the exhaust pipe and the combined gasses exit the housing at a second velocity greater than the first velocity and away from the structure.

2. The apparatus of claim 1, wherein the air pressurization system is computer controlled.

3. The system of claim 1, wherein the injected air creates a pressure reduction in the exhaust gasses.

4. The system of claim 1, wherein an annular region is formed between an inside surface of the housing and an outside surface of the pipe.

5. The system of claim 4, wherein an exit portion of the housing comprises a converging nozzle.

6. The system of claim 5, wherein the annular region has an area substantially equal to a discharge area of the pressurization system.

7. The system of claim 6, wherein the air pressurization system comprises an air inlet, a pressurization device, and a housing transition.

8. The system of claim 7, wherein the air pressurization device is selected from the group consisting of: an axial fan, an axial blower, a centrifugal fan, a centrifugal blower, a non-overloading fan, and a non-overloading blower.

9. The system of claim 7, further comprising turning and straightening vanes in the housing.

10. The system of claim 9, further comprising a mounting spool or vane section coupled to the pressurization device.

11. The system of claim 1, wherein the pressurization created by the pressurization system is adjustable.

12. The system of claim 11, wherein the air pressurization system is computer controlled.

13. The system of claim 1, wherein the pressurization system comprises a ducted axial blower.

14. The system of claim 13, wherein the pressurization system comprises a non-overloading axial blower.

15. The system of claim 13, wherein the pressurization system comprises a non-stalling axial blower.

16. A method of manipulating engine exhaust gases away from a structure, comprising:

providing a housing having a converging nozzle at one end;

coupling the housing to a terminal portion of an engine exhaust pipe;

coupling a separately motorized air pressurization system to the housing;

injecting air from the separately motorized air pressurization system into the housing;

entraining the exhaust gases with the injected air; and expelling the combined fluid through the nozzle at a velocity greater than the exhaust gas alone and away from the structure.

17. The method of claim 16 further comprising determining how much pressurization from the air pressurization is needed to adequately manipulate the exhaust gases.

18. The method of claim 16, further comprising determining one or more weather conditions.

19. The method of claim 16, further comprising increasing the operating efficiency of an engine.

20. The method of claim 16 further comprising creating an annular region between the housing and the pipe.

21. The method of claim 20, further comprising injecting the air at a velocity substantially equal to or greater than a velocity of exhaust gases exiting the pipe.

22. The method of claim 21, further comprising locating the housing substantially cylindrically about the pipe.

23. The method of claim 22, further comprising providing an air inlet hood for the air pressurization system.

24. The method of claim 16, further comprising determining the current speed of the engine.

25. The method of claim 24, further comprising adjusting the pressurization based on at least the engine speed and one or more conditions.

26. The method of claim 16, further comprising adjusting the amount of air injected.

27. The method of claim 26, further comprising adjusting the amount of air injected based one or more conditions.

28. The method of claim 27, wherein the condition for adjusting the amount of injected air is selected from the group consisting of: engine speed, exhaust temperature, presence of exhaust gas, presence of personnel, and weather conditions.

29. An apparatus for increasing the velocity of an exhaust gas, comprising:

a body comprising a housing having an exit portion comprising a converging nozzle; and a conduit associated with an engine on a structure and disposed within and coupled to the housing such that an annular region is defined between an inside surface of the housing and an outside surface of the conduit;

an air pressurization system having a discharge portion coupled to the body and in fluid communication with the annular region, the discharge portion having an area that is approximately the same as or more than the annular region area; and whereby air is injected into the housing by the air pressurization system at a velocity greater than a velocity of the exhaust gas exiting the conduit and the injected air entrains exhaust gas and the combined fluid exits the converging nozzle directly into the atmosphere in a substantially cylindrical pattern and away from the structure.

30. The apparatus of claim 29, wherein the conduit is coupled to a terminal portion of an exhaust system.

31. The apparatus of claim 29, wherein the pressurization created by the pressurization system is adjustable.

32. The apparatus of claim 29, wherein the air pressurization system comprises an air inlet, a pressurization device, and a transition.

33. The apparatus of claim 32, wherein the air pressurization device is selected from the group consisting of: an axial fan, an axial blower, a centrifugal fan, a centrifugal blower, a non-overloading fan, and a non-overloading blower.

34. The apparatus of claim 33, further comprising turning and straightening vanes in the body.

35. The apparatus of claim 32, the transition comprises a vane section.

36. The apparatus of claim 29, wherein the pressurization system comprises a ducted axial blower.

37. The apparatus of claim 36, wherein the pressurization system comprises a non-overloading axial blower.

38. The apparatus of claim 36, wherein the pressurization system comprises a non-stalling axial blower.

39. A method of increasing the velocity of engine exhaust gases, comprising:

providing a structure having an engine and an engine exhaust associated therewith;

providing a body comprising a housing having an exit portion comprising a converging nozzle, and a conduit disposed within and coupled to the housing such that an annular region is defined between an inside surface of the housing and an outside surface of the conduit;

providing an air pressurization system having a discharge portion coupled to the body and in fluid communication with the annular region, the discharge portion having an area that is approximately the same as or more the annular region area;

injecting air from the air pressurization system into the body;

coupling the engine exhaust to the conduit;

entraining exhaust gases exiting the conduit with the injected air; and expelling the combined fluid from the body and directly into the atmosphere at a velocity greater than the exhaust gas alone and away from the structure.

40. The method of claim 39, further comprising injecting the air at a velocity substantially equal to or greater than a velocity of exhaust gases exiting the conduit.

41. The method of claim 39, further comprising locating the housing substantially cylindrically about the conduit.

42. The method of claim 39, further comprising providing an air inlet hood for the air pressurization system.

43. The method of claim 39 further comprising determining how much pressurization from the air pressurization is needed to adequately manipulate the exhaust gases.

44. The method of claim 39, further comprising determining one or more weather conditions.

45. The method of claim 39, further comprising increasing the operating efficiency of an engine.

46. The method of claim 39, further comprising determining the current speed of the engine.

47. The method of claim 46, further comprising adjusting the pressurization based on at least the engine speed and one or more conditions.

48. The method of claim 39, further comprising adjusting the amount of air injected.

49. The method of claim 48, further comprising adjusting the amount of air injected based one or more conditions.

50. The method of claim 49, wherein the condition for adjusting the amount of injected air is selected from the group consisting of: engine speed, exhaust temperature, presence of exhaust gas, presence of personnel, weather conditions and one or combination of these.

51. An apparatus for manipulating an exhaust gas, comprising:

a body comprising a housing having an exit portion, the exit portion comprising a converging nozzle;

a conduit disposed within at least a portion of the housing and coupled to the housing such that an annular region is defined between an inside surface of the housing and an outside surface of the conduit; and the conduit adapted to couple with a terminal portion of an exhaust gas pipe from an exhaust gas-producing engine on a structure;

an air pressurization system comprising a separately motorized air mover and a discharge section, the air pressurization system coupled to the body in sealed arrangement such that the air pressurization system is in fluid communication with the annular region, and has a discharge section area that is approximately the same as or more than the annular region area; and whereby air may be injected into the body by the air pressurization system and the combined air and exhaust gas are expelled through the converging nozzle and directed away from the structure.

52. A method of directing exhaust gases away from a structure, comprising:

providing a body comprising a housing having an exit portion comprising a converging nozzle, and a conduit disposed within at least a portion of the housing and coupled to the housing such that an annular region is defined between an inside surface of the housing and an outside surface of the conduit, the conduit adapted to couple with a terminal portion of an exhaust pipe of an engine located on the structure;

providing an air pressurization system comprising a separately motorized air mover and a discharge section, the air pressurization system coupled to the body in sealed arrangement such that the air pressurization system is in fluid communication with the annular region, and has a discharge section area that is approximately the same as or more than the annular region area;

injecting air from the air pressurization system into the body; and expelling the combined air and exhaust gas from the body at a velocity greater than the exhaust gas alone and away from the structure.

* * * * *

US007707828C1

(12) EX PARTE REEXAMINATION CERTIFICATE (10301st)

United States Patent

Leseman et al.

(10) Number: US 7,707,828 C1

(45) Certificate Issued: Sep. 29, 2014

(54) METHOD AND APPARATUS FOR MANIPULATING AND DILUTING INTERNAL COMBUSTION ENGINE EXHAUST GASES

(75) Inventors: Gary Thelen Leseman, Houston, TX (US); Joseph Byron Davis, Sugar Land, TX (US)

(73) Assignee: Leseman Davis, LLC, Houston, TX (US)

Reexamination Request:
No. 90/013,074, Dec. 4, 2013

Reexamination Certificate for:

| | |
|---|---|
| Patent No.: | **7,707,828** |
| Issued: | **May 4, 2010** |
| Appl. No.: | **11/608,587** |
| Filed: | **Dec. 8, 2006** |

Related U.S. Application Data

(63) Continuation-in-part of application No. 11/307,712, filed on Feb. 17, 2006, now abandoned.

(60) Provisional application No. 60/751,459, filed on Dec. 19, 2005.

(51) Int. Cl.
*F02B 35/00* (2006.01)

(52) U.S. Cl.
USPC ..... 60/316; 60/274; 60/315; 60/317

(58) Field of Classification Search
None
See application file for complete search history.

(56) References Cited

To view the complete listing of prior art documents cited during the proceeding for Reexamination Control Number 90/013,074, please refer to the USPTO's public Patent Application Information Retrieval (PAIR) system under the Display References tab.

*Primary Examiner* — Joseph A. Kaufman

(57) ABSTRACT

A system for manipulating engine exhaust gases away from inhabited areas comprises an air pressurization system coupled in fluid communication to a housing. The housing is adapted to reside adjacent a terminal portion of an exhaust pipe so that pressurized air injected into the housing entrains the exhaust gases and disperses them from the housing.

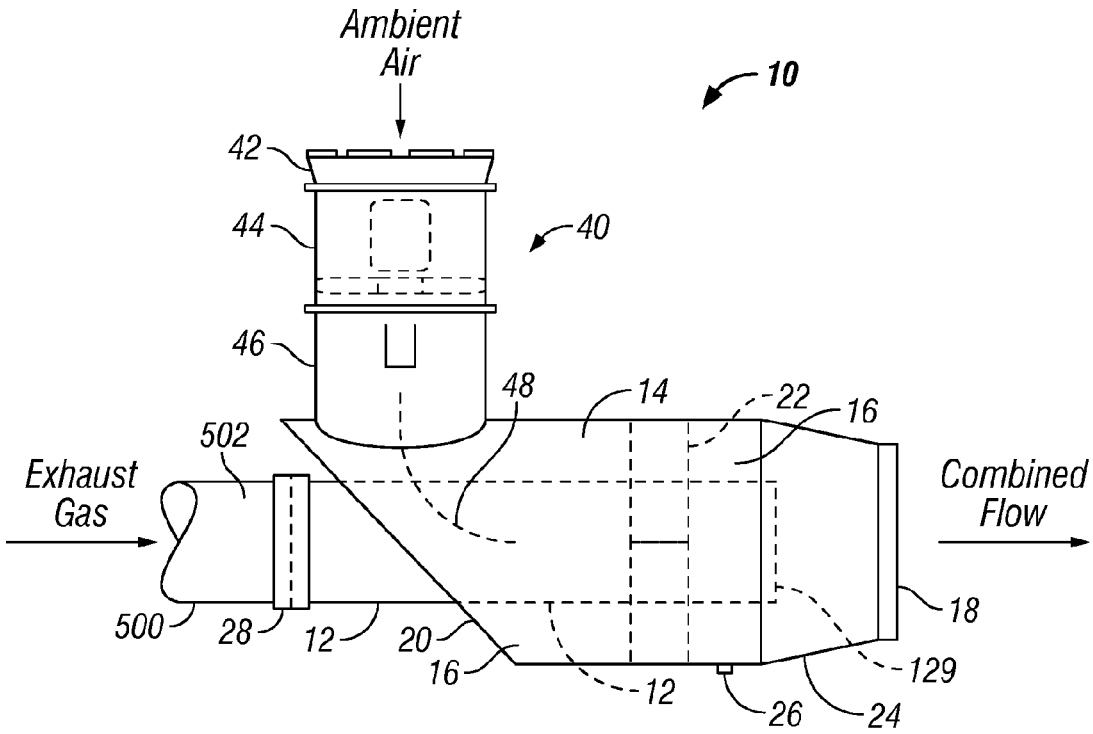

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-52 is confirmed.

* * * * *